US005899296A

United States Patent [19]

Lantz

[11] Patent Number: 5,899,296

[45] Date of Patent: May 4, 1999

[54] STEP LADDER SCAFFOLD APPARATUS

[76] Inventor: Harvey D. Lantz, 310 SW. 2nd, Abilene, Kans. 67410

[21] Appl. No.: 08/823,321

[22] Filed: Mar. 21, 1997

[51] Int. Cl.[6] ..... E06C 7/06

[52] U.S. Cl. ..... 182/214; 182/107; 248/238

[58] Field of Search ..... 182/107, 120, 182/129, 214; 248/210

[56] References Cited

U.S. PATENT DOCUMENTS

| | | | |
|---|---|---|---|
| 2,720,354 | 10/1955 | Stanley | 182/214 |
| 2,840,291 | 9/1958 | Becker | 228/60 |
| 3,028,929 | 4/1962 | Chubbs | 182/206 |
| 3,042,142 | 7/1962 | Butler | 182/129 |
| 3,146,854 | 9/1964 | Terwilliger | 182/120 |
| 3,653,462 | 4/1972 | Courtney | 182/108 |
| 3,910,378 | 10/1975 | Nyman | 182/214 |
| 4,184,569 | 1/1980 | Grenier | 182/206 |
| 4,369,860 | 1/1983 | Beane | 182/214 |
| 4,446,945 | 5/1984 | Anderson | 182/229 |
| 4,580,660 | 4/1986 | Oling | 182/107 |
| 4,643,274 | 2/1987 | Tataseo | 182/214 |
| 4,862,994 | 9/1989 | Hughes, Sr. | 182/122 |
| 5,058,707 | 10/1991 | Waid | 182/120 |
| 5,664,643 | 9/1997 | Taylor | 182/214 |
| 5,740,883 | 4/1998 | Trank | 182/129 |

*Primary Examiner*—Daniel P. Stodola
*Assistant Examiner*—Hugh B. Thompson
*Attorney, Agent, or Firm*—Flanagan & Flanagan; John K. Flanagan; John R. Flanagan

[57] ABSTRACT

A scaffold apparatus includes a mounting frame releasably attachable to a top platform of a step ladder, a brace attached to the mounting frame and extending outwardly for holding the mounting frame and the step ladder in a spaced relation away from a building structure, and a receptacle for removable attachment to the brace and defining a cavity for retaining articles therein. The mounting frame includes a pair of pins and clips and a pair of C-shaped side clamp members for releasably attaching the frame to the step ladder. Each C-shaped side clamp member defines a channel therethrough and a pair of aligned apertures at a rear end. Each pin is removably insertable through one of the pair of aligned apertures defined at the rear ends of the C-shaped side clamp members for releasably retaining the mounting frame on the top platform of the step ladder. Each clip is for removable attachment to one of the pins following insertion of the one pin through the one pair of aligned apertures such that the one pin cannot be displaced from the one pair of aligned apertures without removal of the clip. The brace includes a pair of side support members and a front support member disposed in a triangular shaped arrangement extending forwardly from the mounting frame for engaging and resting against the building structure.

8 Claims, 2 Drawing Sheets

STEP LADDER SCAFFOLD APPARATUS

BACKGROUND OF THE INVENTION

1. Field of the Invention

The present invention generally relates to ladder attachments and, more particularly, is concerned with a scaffold apparatus for attachment to a step ladder.

2. Description of the Prior Art

Ladders are often needed for a user to access the walls and roof of a variety of buildings including, but not limited to, residential homes. Many roofs, however, have overhangs which extend outwardly beyond the plane of the wall supporting them from below. Roof overhangs make it difficult for a user to reach the top surface of the roof for shingling and the like and to reach the edge of the roof for working on a gutter and the like. This is due to the fact that ladders often must lean against the wall under the roof overhang such that a user on or near the top step or rung of a ladder is placed into an awkward position for reaching the edge or top surface of the roof. It is further difficult for the user to paint a wall when the ladder must be supported directly against the wall to be painted. Thus, it is often desirable for the user standing on or near the top step or rung of the ladder to be spaced outwardly away from the wall which is supporting the ladder. It may also be desirable for the user to have a receptacle for holding tools, paint cans and the like in close proximity to the region of the ladder upon which the user is standing.

A variety of devices which are attachable to ladders have been proposed over the years to resolve the above-mentioned difficulties. Representative examples of these prior art ladder attachment devices and the like are disclosed in U.S. Pat. No. 2,840,291 to Becker, U.S. Pat. No. 3,028,929 to Chubbs, U.S. Pat. No. 3,042,142 to Butler, U.S. Pat. No. 3,146,854 to Terwilliger, U.S. Pat. No. 3,653,462 to Courtney, U.S. Pat. No. 4,184,569 to Grenier, U.S. Pat. No. 4,369,860 to Beane, U.S. Pat. No. 4,446,945 to Anderson, U.S. Pat. No. 4,643,274 to Tataseo and U.S. Pat. No. 4,862,994 to Hughes, Sr. Each of the above-listed patents, however, disclose devices which have one or more of the following problems associated with them: high cost, time consuming and tedious to install onto and/or remove from the ladder, applicable only to rung ladders and/or have undue complexity of construction.

Consequently, a need still exists for an apparatus which provides a solution to the aforementioned problems in the prior art without introducing any new problems in place thereof.

SUMMARY OF THE INVENTION

The present invention provides a scaffold apparatus designed to satisfy the aforementioned need and to be used primarily with step ladders. The scaffold apparatus of the present invention gives a user access to the walls and roof of buildings by spacing a step ladder outwardly away from the walls. The scaffold apparatus also provides the user with a receptacle for placement of tools, paint cans and the like in close proximity. The scaffold apparatus has a construction which is relatively simple and reasonable in cost, is easy to attach to and remove from a ladder, and is applicable to step ladders. Furthermore, the scaffold apparatus has a reliable, secure means for attachment to step ladders which arguably are most stable forms of ladder for a foot of the user to stand on.

Accordingly, the present invention is directed to a step ladder scaffold apparatus which comprises: (a) a mounting frame for releasable attachment to a top platform of a step ladder; (b) a brace attached to the mounting frame and extending outwardly therefrom for holding the mounting frame and the step ladder in a spaced relation away from a building structure; and (c) a receptacle for removable attachment to the brace and defining a cavity for retaining articles therein.

The mounting frame has a pair of C-shaped side clamp members, a cross member and a pair of pins and clips. Each of the pair of C-shaped side clamp members defines a channel therethrough and a pair of aligned apertures at a rear end thereof. The cross member is rigidly connected with and extends between the pair of C-shaped side clamp members. Each pin is insertable through one of the pair of aligned apertures defined at the rear ends of the pair of C-shaped side clamp members for releasably retaining the mounting frame on the top platform of the step ladder with the top platform extending through the channels defined by the pair of C-shaped side clamp members. Each clip is removably attachable to one of the pins following insertion of the one pin through the one pair of aligned apertures such that the one pin cannot be displaced from the one pair of aligned apertures without removal of the clip.

The brace has a pair of side support members and a front support member. The pair of side support members are attached at rear ends on the mounting frame and extend forwardly beyond the mounting frame in divergent relationship to one another. The front support member extends between and is mounted to front ends of the pair of side support members for engaging and resting against the building structure. The brace further has a tubing comprised of a substantially non-abrasive material surrounding the front support member thereof. The brace also has a pair of caps comprised of a substantially non-abrasive material covering each end of the front support member thereof.

The receptacle includes a tray formed by a bottom wall and a plurality of side walls connected to and extending upwardly from said bottom wall and defining the cavity. The receptacle also includes a vertical sleeve mounted to and extending upwardly from the bottom wall of the tray, a pair of opposite hangers attached to and extending outwardly from at least a spaced pair of the side walls of the tray, and a flange attached to and extending outwardly from another one of the side walls that extends between the spaced pair of the plurality of side walls. The pair of opposite hangers are adapted to support the tray on the brace forwardly of the mounting frame such that the tray is disposed between the divergent side support members of the brace. The flange defines a plurality of spaced holes for receiving and retaining articles.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which.

DETAILED DESCRIPTION OF THE INVENTION

Figure 1:
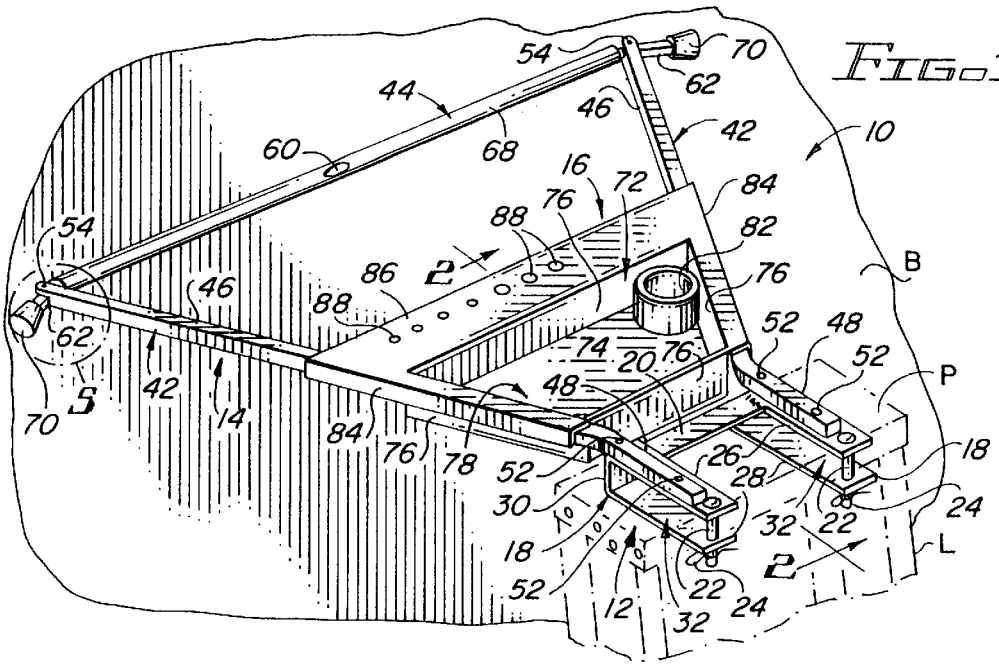
FIG. 1 is a perspective view of a scaffold apparatus of the present invention attached to a step ladder shown in phantom.

Referring to the drawings and particularly to FIG. 1, there is illustrated a scaffold apparatus, generally designated 10, of the present invention. The scaffold apparatus 10 basically includes a mounting frame 12 for releasable attachment to a flat top plate or platform P of a step ladder L, a brace 14 attached to the mounting frame 12 and extending outwardly therefrom for holding the mounting frame 12 and the step ladder L in spaced relation away from a building structure B, and an article receiving receptacle 16 for removable attachment to the brace 14 and for retaining articles (not shown) therein.

Referring now to FIGS. 1, 2, 6 to 8 and 11, the mounting frame 12 of the scaffold apparatus 10 includes a pair of generally C-shaped side clamp members 18, a cross member 20 and a pair of pins 22 and clips 24. Each C-shaped side clamp member 18 of the mounting frame 12 has a pair of opposing upper and lower arm portions 26, 28 and a front end connecting or bight portion 30 which extends therebetween and is integrally formed therewith. The upper and lower arm portions 26, 28 and front end bight portion 30 together define a channel 32 extending between a closed front end 18A and an open rear end 18B of each channel member 18. Each C-shaped side clamp member 18 also defines a pair of aligned upper and lower apertures 34, 36 at the rear end 18B thereof. The aligned apertures 34, 36 are respectively formed in the upper and lower arm portions 26, 28 directly across from one another. The upper arm portion 26 of each clamp member 18 also has a pair of spaced apart holes 38 defined therethrough. The cross member 20 is rigidly attached with and extends between the front ends 18A of the upper arm portions 26 of the clamp members 18 and extends in the same plane as the upper arm portions 26. The cross member 20 and the upper and lower arm portions 26, 28 and the bight portions 30 of the clamp members 18 are generally flat and rectangular in shape with similar widths and thicknesses and are comprised of a substantially rigid material, such as a suitable metal. Each of the upper and lower arm portions 26, 28 has a length which is substantially greater than that of each of the bight portions 30.

Each pin 22 of the mounting frame 12 is removably insertable through one of the pair of aligned apertures 34, 36 at the rear end 18B of each of the C-shaped side clamp members 18 for releasably retaining the mounting frame 12 on the top plate or platform P of the step ladder L with the top platform P extending through the respective channels 32 of C-shaped side clamp members 18. Each pin 22 has a diameter slightly less than that of each of the aligned apertures 34, 36 has a diameter slightly greater than that of each pin 22.

Figure 2:
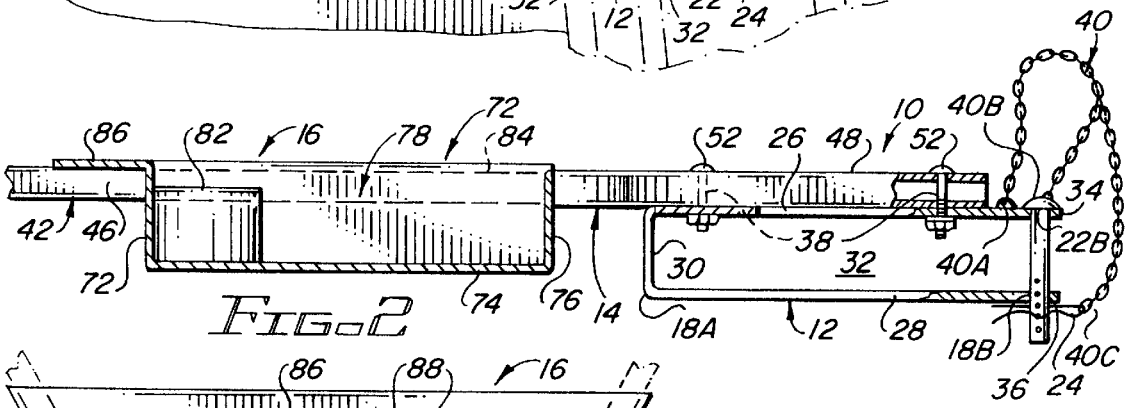
FIG. 2 is an enlarged fragmentary partially sectional side elevational view of the scaffold apparatus taken along line 2—2 of FIG. 1.
Figure 3:
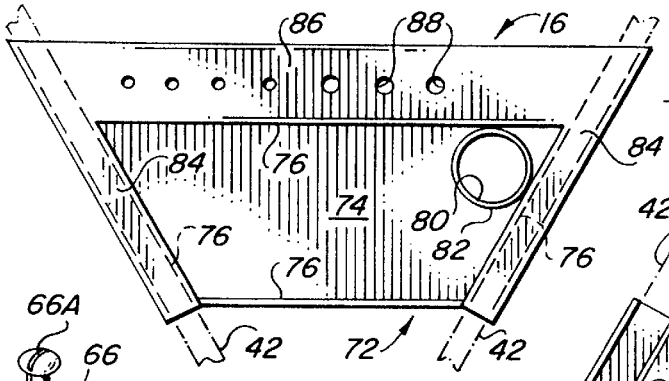
FIG. 3 is an enlarged top plan view of a receptacle supported on a pair of side support members of a brace of the apparatus.
Figure 4:
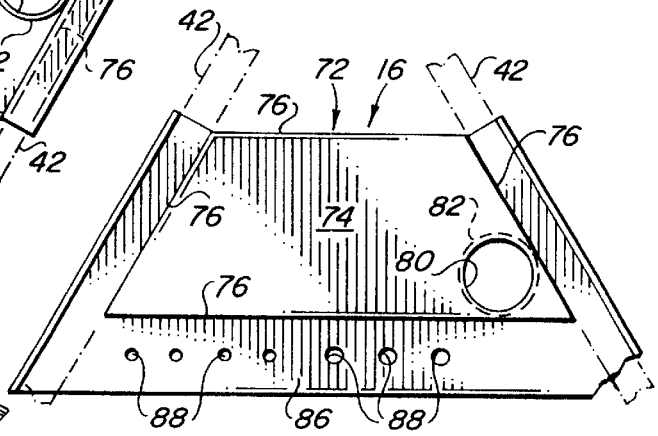
FIG. 4 is an enlarged bottom plan view of the receptacle and side support members of the brace shown in FIG. 3.
Figure 5:
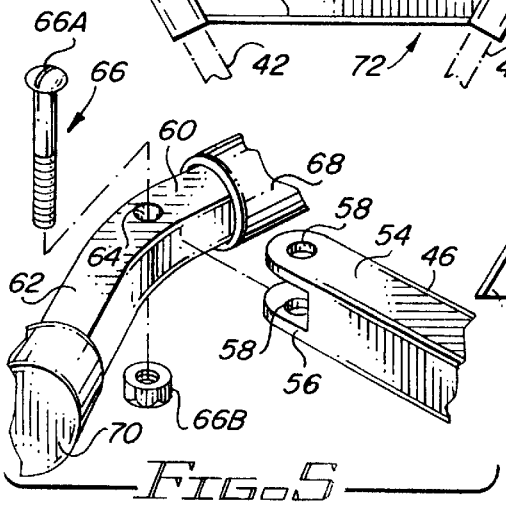
FIG. 5 is an enlarged exploded perspective detailed view of the area enclosed by circle 5 of FIG. 1.
Figure 6:
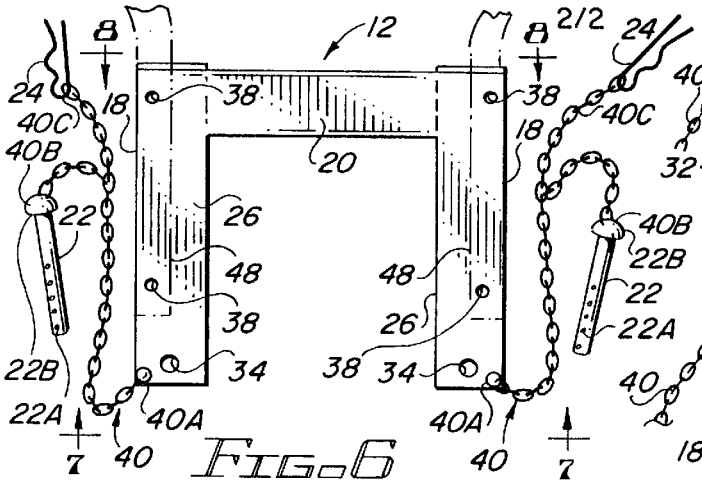
FIG. 6 is an enlarged bottom plan view of a mounting frame of the apparatus with rear end portions of the side support members of the brace attached thereto being shown in phantom.
Figure 7:
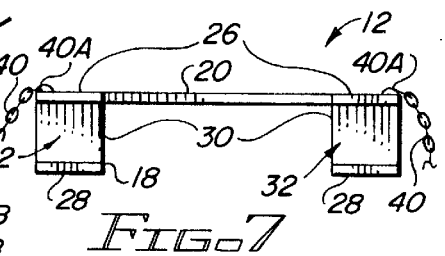
FIG. 7 is an enlarged front elevational view of the mounting frame as seen along line 7—7 of FIG. 6.
Figure 8:
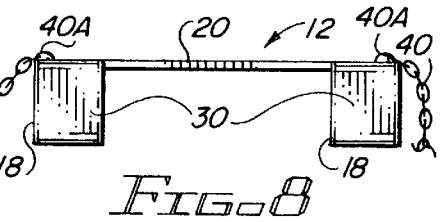
FIG. 8 is an enlarged rear elevational view of the mounting frame as seen along line 8—8 of FIG. 6.
Figure 9:
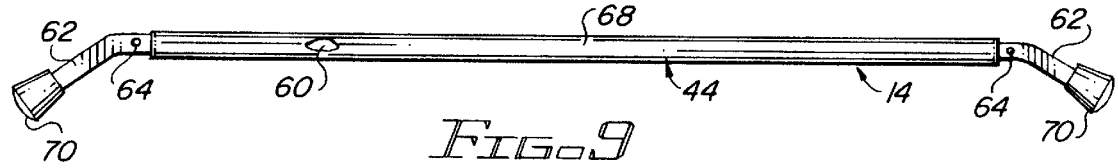
FIG. 9 is an enlarged top plan view of a front support member of the brace of the apparatus.
Figure 10:
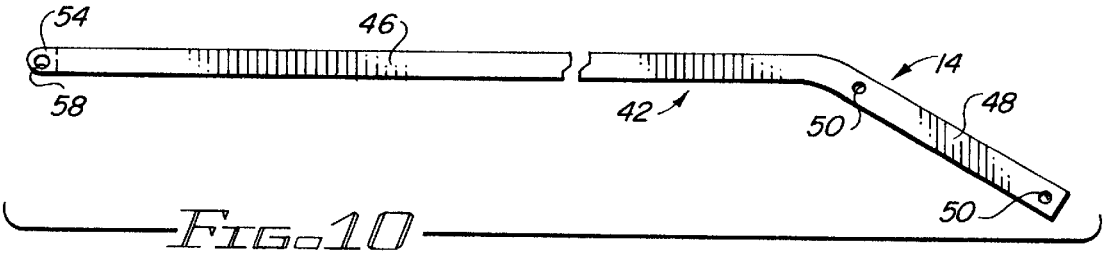
FIG. 10 is an enlarged foreshortened top plan view of the side support member of the brace.
Figure 11:
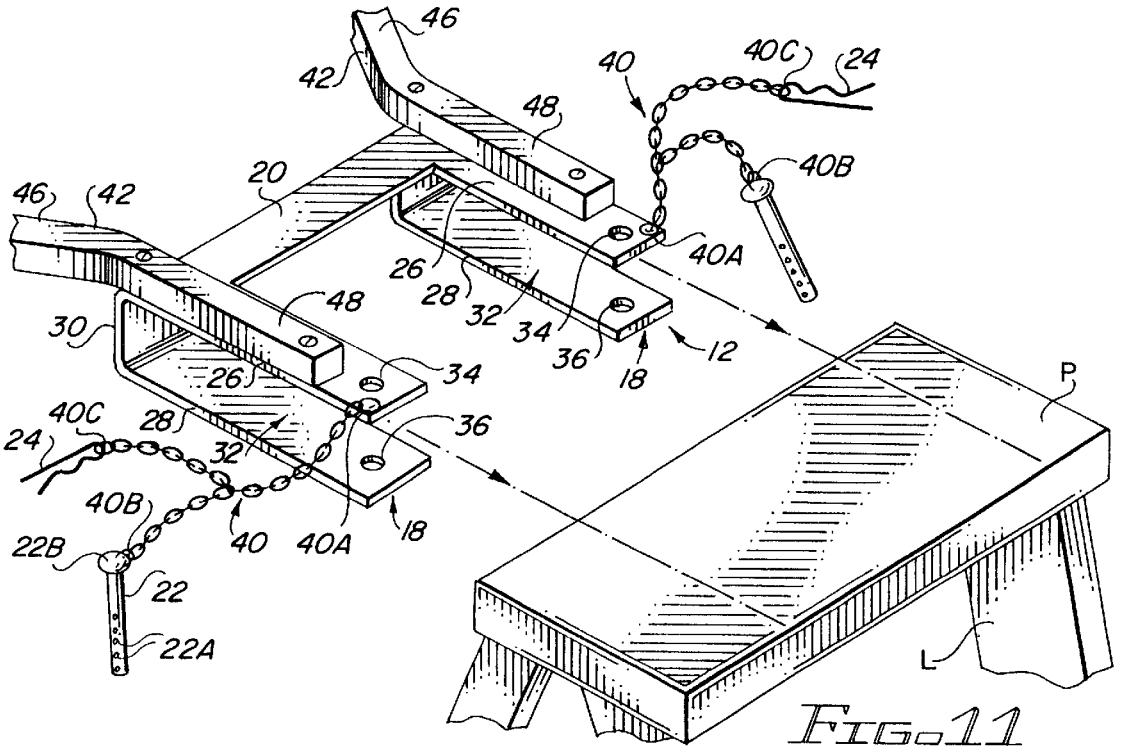
FIG. 11 is an enlarged perspective view of the mounting frame and portions of the side support members of the brace shown detached from the step ladder.

Each clip 24 of the mounting frame 12 is removably attachable to a selected one of a plurality of spaced apart holes 22A through the body of one of the pins 22 following insertion of the one pin 22 through one of the pair of aligned apertures 34, 36. Thus, the inserted pin 22, as shown in FIGS. 1 and 2, cannot be displaced from the pair of aligned apertures 34, 36 and removed from the clamp member 18 without first removal of the respective clip 24. The clip 24 is formed by a narrow wire of substantially rigid yet slightly bendable material which retains its shape upon application to the pin 22.

The mounting frame 12 is thus releasably attachable to the top platform p of the step ladder L by passage of the top platform P into the channels 32 between the upper and lower arm portions 26, 28 of the respective C-shaped side clamp members 18 until the front end bight portion 30 thereof and the pairs of aligned apertures 36 are on opposite sides of the top platform P. The pins 22 are then inserted through the pairs of aligned apertures 34, 36 and held in the inserted positions by the application of the clips 24, as shown particularly in FIGS. 1 and 2, through selected ones of the holes 38 in the pins 22. The pins 22 are removable from the pins upon release of the clips 24, as shown particularly in FIGS. 6 and 11, from the pins 22.

The mounting frame 12 also includes a pair of flexible chains 40 for tethering the pins 22 and clips 24 from the upper arm portions 26 of the clamp members 18. Each chain 40 is substantially Y-shaped and has three ends 40A, 40B, 40C. One end 40A is attached to one of the upper arm portions 26 by any suitable means. Another end 40B is attached to the head 22B of one of the pins 22 by any suitable means. A third end 40C is attached to one of the clips 24 by any suitable means.

Referring now to FIGS. 1 to 6 and 9 to 11, the brace 14 of the scaffold apparatus 10 includes a pair of rigid side support members 42 and a rigid front support member 44. Each side support member 42 has a front end portion 46 and a rear end portion 48. The rear end portions 48 of the side support members 42 are in substantially parallel relation to one another. The front end portions 46 of the side support members 42 are in a substantially diverging relation to one another as the front end portions 46 extend forwardly and outwardly from the rear end portions 48. The front end portions 46 have a length which is substantially greater than that of the rear end portions 48. The rear end portions 48 each have a pair of spaced apart holes 50 defined therethrough for positioned above and in alignment with the pair of spaced apart holes 38 defined through the upper arm portion 26 of each C-shaped side clamp member 18 of the mounting frame 12. Fasteners 52 are removably insertable through the respective aligned pairs of spaced apart holes 38, 50 for attachment of the side support members 42 of the brace 14 to the upper arm portions 26 of the C-shaped side clamp members 18 of the mounting frame 12. The side support members 42 of the brace 14 may also be attached to the mounting frame 12 by any other suitable means.

Each side support member 42 further has a pair of upper and lower tabs 54, 56 which extend forwardly from the front end portion 46 thereof. The upper and lower tab 54, 56 have apertures 58 in alignment with one another. The front support member 44 extends between and is mounted to the front end portions 46 of the side support members 42 and is adapted to engage and rest against the building structure B. The front support member 44 has an elongated middle portion 60 and a pair of opposite end portions 62. The opposite end portions 62 are angled rearwardly in relation to the middle portion 60. The middle portion 60 has a length which is substantially greater than that of the opposite end portions 62. The front support member 44 further has a pair of openings 64 defined therethrough at the junctions of the opposite end portions 62 and the middle portion 60. The openings 64 can be aligned with the apertures 58 of the tabs 54, 56 of the side support members 42. Fastener 66, in the form of conventional bolts and nuts 66A, 66B, are removably insertable through the apertures 58 and openings 64 for attachment of the respective side support members 42 to the opposite end portions 62 of the front support member 44 of the brace 14. The side support members 42 and front support member 44 are each substantially rectangular in shape with similar widths and thicknesses and are comprised of a substantially rigid material. The brace 14 further has a flexible tubing 68 comprised of a substantially non-abrasive material and surrounding the front support member 44 thereof. The brace 14 also has a pair of caps 70 each comprised of a substantially non-abrasive material and covering the ends of the opposite end portions 62 of the front support member 44 thereof.

Referring now to FIGS. 1 to 4, the receptacle 16 of the scaffold apparatus 10 includes a tray 72 formed by a bottom wall 74 and a plurality of side walls 76 arranged in a trapezoidal configuration and connected to and extending upwardly from bottom wall 74 and connected to one another so as to define cavity 78 for receiving articles. The receptacle 16 also has a hole 80 defined through the bottom wall 74 and includes a vertical cylindrical sleeve 82 rigidly mounted to and extending upwardly from the bottom wall 74 of the tray 72. The receptacle further includes a pair of opposite hangers 84 attached to and extending outwardly from at least a spaced pair of the side walls 76 of the tray 72, and a flange 86 attached to and extending outwardly from another one of the side walls 76 that extends between the spaced pair of the plurality of side walls 76. The pair of opposite hangers 84 are adapted to support the tray 72 on the brace 14 forwardly of the mounting frame 12 such that the tray 72 is disposed between the divergent side support members 42 of the brace 14. The flange 86 defines a plurality of spaced holes 88 for receiving and retaining articles.

It is thought that the present invention and its advantages will be understood from the foregoing description and it will be apparent that various changes may be made thereto without departing from the spirit and scope of the invention or sacrificing all of its material advantages, the form hereinbefore described being merely preferred or exemplary embodiment thereof.

I claim:

1. A scaffold apparatus, comprising:

(a) a mounting frame for releasable attachment to a top platform of a step ladder, said mounting frame including (i) a pair of side clamp members each having a pair of aligned upper and lower arm portions with opposite front and rear ends and a bight portion extending between and interconnecting said upper and lower arm portions at said front ends thereof such that said side clamp members are open between said rear ends of said upper and lower arm portions and extend therefrom to said bight portions at said front ends thereof so as to define channels for receiving the top platform of the step ladder therewithin, (ii) a cross member extending between and rigidly attached to said side clamp members adjacent to said front ends of said upper arm portions thereof, and (iii) means for releasably retaining the top platform of the step ladder within said channels of said side clamp members of said mounting frame; and (b) a brace attached to said mounting frame and extending outwardly therefrom for holding said mounting frame and the step ladder in a spaced relation away from a building structure, said brace including a pair of side support members having rear end portions overlying and rigidly attached on said upper arm portions of said side clamp members of said mounting frame and extending beyond said cross member of said mounting frame toward said rear ends of said upper arm portions thereof such that said mounting frame is disposed below said rear end portions of said side support members of said brace.

2. The apparatus of claim 1 further comprising:

a receptacle for removable attachment to said side support members of said brace and defining a cavity for retaining articles therein.

3. The apparatus of claim 1 wherein said brace further includes a front support member, said pair of side support members extending forwardly beyond said mounting frame in divergent relationship to one another, said front support member extending between and being mounted to front ends of said pair of side support members for engaging and resting against the building structure.

4. The apparatus of claim 3 wherein said brace further includes a tubing comprised of a substantially non-abrasive material surrounding said front support member thereof.

5. The apparatus of claim 3 wherein said brace further includes a pair of caps comprised of a substantially non-abrasive material covering each end of said front support member thereof.

6. The apparatus of claim 1 wherein each of said side clamp members of said mounting frame further includes:

a pair of aligned apertures defined at said rear ends of said upper and lower arm portions of said side clamp member; and a pin removably insertable through said pair of aligned apertures defined at said rear ends of said upper and lower arm portions of said side clamp member for releasably retaining said mounting frame on the top platform of the step ladder with the top platform extending through said channels of said side clamp members.

7. The apparatus of claim 6 wherein said each of said side clamp members of said mounting frame further includes a clip removably attachable to said pin following insertion of said pin through said pair of aligned apertures such that said pin cannot be withdrawn from said pair of aligned apertures without removal of said clip.

8. The apparatus of claim 7 wherein said receptacle includes:

a tray formed by a bottom wall and a plurality of side walls connected to and extending upwardly from said bottom wall and defining said cavity;

a vertical sleeve mounted to and extending upwardly from said bottom wall;

a pair of opposite hangers attached to and extending outwardly from at least a spaced pair of said plurality of side walls of said tray; and a flange attached to and extending outwardly from another one of said plurality of side walls extending between said spaced pair of said side walls, said pair of opposite hangers for supporting said tray on said brace forwardly of said mounting frame, said flange defining spaced holes for receiving and retaining articles.

* * * * *